US008372218B2

(12) United States Patent
Nuetzel et al.

(10) Patent No.: US 8,372,218 B2
(45) Date of Patent: Feb. 12, 2013

(54) MAGNET CORE AND METHOD FOR ITS PRODUCTION

(75) Inventors: Dieter Nuetzel, Hainburg (DE); Markus Brunner, Bessenbach (DE)

(73) Assignee: Vacuumschmelze GmbH & Co. KG, Hanau (DE)

( * ) Notice: Subject to any disclaimer, the term of this patent is extended or adjusted under 35 U.S.C. 154(b) by 775 days.

(21) Appl. No.: 12/308,179

(22) PCT Filed: Jun. 19, 2007

(86) PCT No.: PCT/IB2007/052335

§ 371 (c)(1),
(2), (4) Date: Apr. 10, 2009

(87) PCT Pub. No.: WO2008/007263

PCT Pub. Date: Jan. 17, 2008

(65) Prior Publication Data

US 2009/0206975 A1 Aug. 20, 2009

Related U.S. Application Data

(60) Provisional application No. 60/805,599, filed on Jun. 23, 2006.

(30) Foreign Application Priority Data

Jun. 19, 2006 (DE) ..... 10 2006 028 389

(51) Int. Cl.
*H01F 1/147* (2006.01)
*H01F 1/22* (2006.01)

(52) U.S. Cl. ..... 148/307; 148/306; 148/315; 148/104

(58) Field of Classification Search ..... None
See application file for complete search history.

(56) References Cited

U.S. PATENT DOCUMENTS

| | | | |
|---|---|---|---|
| 3,255,512 | A | 6/1966 | Lochner et al. |
| 4,059,462 | A | 11/1977 | Masumoto et al. |
| 4,076,861 | A | 2/1978 | Furukawa et al. |
| 4,201,837 | A | 5/1980 | Lupinski |
| 4,305,056 | A | 12/1981 | Mochida et al. |
| 4,472,334 | A | 9/1984 | Gallimard |
| 4,543,208 | A | 9/1985 | Horie et al. |
| 4,601,765 | A | 7/1986 | Soileau et al. |
| 4,743,311 | A | 5/1988 | Schultz et al. |
| 4,783,900 | A | 11/1988 | Hathaway et al. |
| 4,923,533 | A | 5/1990 | Shigeta et al. |
| 4,985,089 | A | 1/1991 | Yoshizawa et al. |
| 5,038,460 | A | 8/1991 | Ide et al. |
| 5,144,745 | A | 9/1992 | Yoshimura et al. |
| 5,160,379 | A | 11/1992 | Yoshizawa et al. |
| 5,252,148 | A | 10/1993 | Shigeta et al. |
| 5,331,730 | A | 7/1994 | Brinn, Jr. |
| 5,449,419 | A | 9/1995 | Suzuki et al. |
| 5,522,948 | A | 6/1996 | Sawa et al. |
| 5,594,397 | A | 1/1997 | Uchikoba et al. |
| 5,741,373 | A | 4/1998 | Suzuki et al. |
| 5,751,207 | A | 5/1998 | Poess |
| 5,762,967 | A | 6/1998 | Sagawa et al. |
| 5,871,681 | A | 2/1999 | Karino et al. |
| 5,973,424 | A | 10/1999 | Engelberger et al. |
| 6,001,272 | A | 12/1999 | Ikuma et al. |
| 6,028,353 | A | 2/2000 | Nakano et al. |
| 6,038,760 | A | 3/2000 | Antoine et al. |
| 6,103,157 | A | 8/2000 | Behm et al. |
| 6,106,376 | A | 8/2000 | Rybak et al. |
| 6,189,204 | B1 | 2/2001 | Shikama et al. |
| 6,284,061 | B1 * | 9/2001 | Inoue et al. ..... 148/304 |
| 6,373,368 | B1 | 4/2002 | Shikama et al. |
| 6,392,525 | B1 | 5/2002 | Kato et al. |
| 6,478,889 | B2 | 11/2002 | Kanekiyo et al. |
| 6,663,815 | B1 | 12/2003 | Hundt et al. |
| 6,682,681 | B1 | 1/2004 | Clark et al. |
| 6,685,882 | B2 | 2/2004 | Deevi et al. |
| 6,710,692 | B2 | 3/2004 | Kato et al. |
| 6,749,767 | B2 | 6/2004 | Mitani et al. |
| 6,750,723 | B2 | 6/2004 | Yoshida et al. |
| 6,814,776 | B2 | 11/2004 | Kanekiyo et al. |
| 6,827,557 | B2 | 12/2004 | Kim |
| 7,172,660 | B2 | 2/2007 | Song et al. |
| 7,175,717 | B2 | 2/2007 | Song et al. |
| 7,265,651 | B2 | 9/2007 | Brunner |
| 7,532,099 | B2 | 5/2009 | Brunner |
| RE41,269 | E | 4/2010 | Hundt et al. |

(Continued)

FOREIGN PATENT DOCUMENTS

| | | |
|---|---|---|
| DE | 502063 | 7/1930 |
| DE | 1564643 | 1/1970 |

(Continued)

OTHER PUBLICATIONS

E. Wolfarth: "Ferromagnetic Materials vol. 2,"—Soft Magnetic Metallic Materials—p. 73 (1980).

ASM Materials Engineering Dictionary, Edited by J.R. Davis, Davis & Associates, 1992, p. 2002.

Official Examination Communication dated Jun. 23, 2009 for Japanese Patent Publication No. JP 2000-565549 (expressed in the German language) and English Translation Certificate of Translation dated Jul. 28, 2009.

G.H. Kim et al., "Magnetic properties of FeCuNbSiB nanocrystalline alloy powder cores using ball-milled powder", Journal of Applied Physics, vol. No. 10, Parts 2 and 3, May 15, 2003, pp. 7211-7213.

(Continued)

*Primary Examiner* — John Sheehan

(74) *Attorney, Agent, or Firm* — Buchanan Ingersoll & Rooney PC

(57) ABSTRACT

Magnet cores pressed using a powder of nanocrystalline or amorphous particles and a pressing additive should be characterized by minimal iron losses. These particles have first surfaces represented by the original strip surfaces and second surfaces represented by surfaces produced in a pulverization process, the overwhelming majority of these second particle surfaces being smooth cut or fracture surfaces without any plastic deformation, the proportion T of areas of plastic deformation of the second particle surfaces being $0 \leqq T \leqq 0.5$.

33 Claims, No Drawings

U.S. PATENT DOCUMENTS

| | | | |
|---|---|---|---|
| 2001/0015239 | A1 | 8/2001 | Kanekiyo |
| 2001/0031837 | A1 | 10/2001 | Perez et al. |
| 2002/0062885 | A1 | 5/2002 | Li |
| 2002/0124914 | A1 | 9/2002 | Kim |
| 2003/0156000 | A1 | 8/2003 | Brunner |
| 2004/0045635 | A1 | 3/2004 | Bandyopadhyay et al. |
| 2004/0079449 | A1 | 4/2004 | Kanekiyo et al. |
| 2004/0089377 | A1 | 5/2004 | Deevi et al. |
| 2004/0183643 | A1 | 9/2004 | Brunner |
| 2005/0028889 | A1 | 2/2005 | Song et al. |
| 2005/0034787 | A1 | 2/2005 | Song et al. |
| 2005/0236071 | A1 | 10/2005 | Koshiba et al. |
| 2007/0193657 | A1 | 8/2007 | Brunner |
| 2008/0001702 | A1 | 1/2008 | Brunner |
| 2009/0206975 | A1 | 8/2009 | Nuetzel et al. |
| 2009/0320961 | A1 | 12/2009 | Brunner |
| 2010/0194507 | A1 | 8/2010 | Brunner |
| 2010/0265016 | A1 | 10/2010 | Petzold et al. |

FOREIGN PATENT DOCUMENTS

| | | | |
|---|---|---|---|
| DE | 2816173 | | 10/1979 |
| DE | 3422281 | A1 | 12/1984 |
| DE | 19608891 | A1 | 9/1997 |
| DE | 69714103 | T2 | 9/1997 |
| DE | 69810551 | T2 | 3/1999 |
| DE | 19846781 | | 4/2000 |
| DE | 198 37 630 | C1 | 5/2000 |
| DE | 19908374 | A1 | 9/2000 |
| DE | 199 42 939 | A1 | 3/2001 |
| DE | 100 64 024 | A1 | 6/2001 |
| DE | 10024824 | | 11/2001 |
| DE | 100 31 923 | A1 | 1/2002 |
| DE | 103 48 808 | B4 | 3/2005 |
| DE | 103 48 810 | A1 | 3/2005 |
| DE | 602 05 728 | T2 | 3/2006 |
| DE | 10 2006 008 283 | | 8/2007 |
| DE | 102006055088 | B4 | 6/2008 |
| EP | 0 302 355 | A1 | 2/1989 |
| EP | 0 502 397 | A2 | 9/1992 |
| EP | 0435680 | B1 | 4/1995 |
| EP | 0455113 | B1 | 6/1997 |
| EP | 0 794 538 | A1 | 9/1997 |
| EP | 0794541 | A1 | 9/1997 |
| EP | 0899 753 | B1 | 3/1999 |
| EP | 0 936 638 | A2 | 8/1999 |
| EP | 1 371 434 | B1 | 12/2003 |
| JP | 56-112710 | | 9/1981 |
| JP | 57-039516 | | 3/1982 |
| JP | 57-122506 | A | 7/1982 |
| JP | 57-187357 | | 11/1982 |
| JP | 59177902 | | 10/1984 |
| JP | 59179729 | A | 10/1984 |
| JP | 60-260108 | | 12/1985 |
| JP | 61058450 | | 3/1986 |
| JP | 61-166902 | | 7/1986 |
| JP | 61-172709 | A | 8/1986 |
| JP | 62-226603 | | 10/1987 |
| JP | 62-232103 | | 10/1987 |
| JP | 63-21807 | | 1/1988 |
| JP | 63-115313 | A | 5/1988 |
| JP | 64-053404 | | 3/1989 |
| JP | 1-139702 | | 6/1989 |
| JP | 02-047812 | | 2/1990 |
| JP | 4-21436 | | 1/1992 |
| JP | 4048005 | A | 2/1992 |
| JP | 41-65605 | | 6/1992 |
| JP | 04-213804 | | 8/1992 |
| JP | 05-283238 | | 10/1993 |
| JP | 05-299232 | | 11/1993 |
| JP | 53-04018 | | 11/1993 |
| JP | 06-224023 | | 8/1994 |
| JP | 82-55717 | | 10/1996 |
| JP | 83-18542 | A | 12/1996 |
| JP | 9-306715 | | 11/1997 |
| JP | 10-092623 | | 4/1998 |
| JP | 10-097913 | | 4/1998 |
| JP | 10-208923 | | 8/1998 |
| JP | 2000-182845 | | 6/2000 |
| JP | 2001-068324 | | 3/2001 |
| JP | 2001-196216 | | 7/2001 |
| JP | 2002-343626 | A | 11/2002 |
| JP | 2004-063798 | A | 7/2004 |
| JP | 2004-349585 | | 12/2004 |
| KR | 10-2005-0018235 | | 2/2005 |
| SU | 338550 | | 5/1972 |
| WO | WO 00/10755 | | 3/2000 |
| WO | WO 00/25326 | | 5/2000 |
| WO | WO 00/28556 | | 5/2000 |
| WO | WO 00/30132 | | 5/2000 |
| WO | WO 01/18828 | A1 | 3/2001 |
| WO | WO 01/91141 | A1 | 11/2001 |
| WO | WO 02/055749 | | 7/2002 |
| WO | WO 03/088281 | A1 | 10/2003 |

OTHER PUBLICATIONS

D. Nuetzel et al., "Nanocrystalline soft magnetic composite-cores with ideal orientation of the powder-flakes", Journal of Magnetism and Magnetic Materials 196-197, (1999), 327-329.

Mazaleyrat et al., "Permeability of Soft Magnetic Composites From Flakes of Nanocrystalline Ribbon," IEEE Transactions of Magnetics, vol. 38, No. 5, Sep. 2002, pp. 3132-3134.

J. Patterson, et al., "Encapsulation of Sensors, Solenoids and Transformers With Engineering Thermoplastics," Proceedings of the Electrical Electronics Insulation Conference, Sep. 18, 1995, pp. 1-6.

Office Action dated Apr. 22, 2010 for German Patent Application No. 10 2009 038 730.7-24 and English Translation of the same.

Examination Report dated Feb. 26, 2003 for German Patent Publication No. 101 34 056.7-33 (English Translation and Certificate of Translation dated Nov. 23, 2009).

Official Action dated May 30, 2000 for German Patent Publication No. 100 24 824.1-33 (German Language).

Notification of Reasons for Refusal dated Jun. 29, 2010 for Japanese Patent Publication No. 2001-587447 and English Translation of the same.

Non-Final Office Action dated Jun. 11, 2009 for U.S. Appl. No. 11/663,271.

Non-Final Office Action dated Sep. 22, 2009 for U.S. Appl. No. 11/663,271.

Final Office Action dated Oct. 30, 2009 for U.S. Appl. No. 11/343,558.

Non-Final Office Action dated Apr. 1, 2010 for U.S. Appl. No. 11/343,558.

Final Office Action dated Oct. 15, 2010 for U.S. Appl. No. 11/343,558.

Non-Final Office Action dated Aug. 31, 2010 for U.S. Appl. No. 11/878,856.

Restriction Requirement dated Nov. 4, 2009 for U.S. Appl. No. 11/878,856.

Non-Final Office Action dated Mar. 22, 2010 for U.S. Appl. No. 11/878,856.

Restriction Requirement dated Sep. 22, 2010 for U.S. Appl. No. 12/219,615.

Restriction Requirement dated Apr. 26, 2010 for U.S. Appl. No. 12/486,528.

Non-Final Office Action dated Jul. 27, 2010 for U.S. Appl. No. 12/486,528.

Non-Final Office Action dated Sep. 29, 2008 for U.S. Appl. No. 11/343,558.

Non-Final Office Action dated Apr. 6, 2009 for U.S. Appl. No. 11/343,558.

Restriction Requirement dated Sep. 19, 2008 for U.S. Appl. No. 11/897,875.

Restriction Requirement dated Dec. 15, 2008 for U.S. Appl. No. 11/897,875.

Non-Final Office Action dated Feb. 23, 2009 for U.S. Appl. No. 11/897,875.

Non-Final Office Action dated Feb. 2, 2010 for U.S. Appl. No. 11/897,875.
Final Office Action dated Jun. 9, 2010 for U.S. Appl. No. 11/897,875.
Non-Final Office Action dated Sep. 9, 2010 for U.S. Appl. No. 11/897,875.
Heczko, O. et al., "Magnetic Properties of Compacted Alloy $Fe_{73.5}Cu_7Nb_3Si_{13.5}B_9$ in Amorphous and Nanocrystalline State", IEEE Transaction Magazine, vol. 29, No. 6, 1993, 2670 English Abstract.
Kawamura, Yoshihito et al., "Fabrication of Nanocrystalline $Fe_{86}Zr_7B_6Cu_1$ Soft-Magnetic Compacts with High Saturation Magnetization", J. Applied Physics (ISSN 0021-8979), vol. 76, No. 9, p. 5545-5551, English Abstract, 1994.
Notification of Preliminary Rejection Reasons dated May 31, 2011 for Korean Patent Application No. 10-2008-7030149 (English language translation).

* cited by examiner

MAGNET CORE AND METHOD FOR ITS PRODUCTION

This application claims benefit of the filing dates of German Patent Application Serial No. DE 10 2006 028 389.9, filed Jun. 19, 2006, and of U.S. Provisional Application Ser. No. 60/805,599, filed Jun. 23, 2006.

BACKGROUND

1. Field

Disclosed herein is a magnet core pressed using an alloy powder and a pressing additive to form a composite. Also disclosed is a method for producing a magnet core of this type.

2. Description of Related Art

The use of powder cores made from iron or alloy powder has been established for many years. Amorphous or nanocrystalline alloys, too, are increasingly used, being superior to other crystalline powders, for example in their remagnetisation properties. Compared to amorphous powders, nanocrystalline powders offer the advantage of higher thermal stability, making magnet cores made from nanocrystalline powders suitable for high operating temperatures.

The raw material for nanocrystalline powder cores typically is an amorphous strip or a strip material made nanocrystalline by heat treatment. The strip, which is usually cast in a rapid solidification process, first has to be mechanically pulverised, for example in a grinding process. It is then pressed together with an additive in a hot or cold pressing process to form composite cores. The finished pressings may then be subjected to heat treatment for turning the amorphous material into nanocrystalline material.

EP 0 302 355 B1 discloses a variety of methods for the production of nanocrystalline powders from iron-based alloys. The amorphous strip is pulverised in vibratory or ball mills.

U.S. Pat. No. 6,827,557 discloses a method for the production of amorphous or nanocrystalline powders in an atomising process. This method involves the problem that the cooling rate of the melt depends heavily on particle size and that the cooling rates required for a homogenous amorphous microstructure are often not obtainable, in particular with larger particles. This results in powder particles with a strongly varying degree of crystallisation.

The level of iron losses is an important characteristic of magnet cores. Two factors contribute to iron losses, these being frequency-dependent eddy-current losses and hysteresis losses. In applications such as storage chokes or filter chokes, for instance, iron losses at a frequency of 100 kHz and a modulation of 0.1 T are relevant. In this typical range, iron losses are dominated by hysteresis losses.

SUMMARY

The magnetic cores, inductive components, and methods disclosed herein are therefore based on the problem of specifying a magnet core made from an alloy powder with minimal hysteresis losses and therefore low iron losses.

In addition, the features disclosed herein are based on the problem of specifying a method suitable for the production of a magnet core of this type.

According to the embodiments disclosed herein, this problem is solved.

In one embodiment disclosed herein is a composite magnet core made from a powder of nanocrystalline or amorphous particles and a pressing additive, wherein the particles have first surfaces represented by the original surfaces of a nanocrystalline or amorphous strip and second surfaces represented by surfaces produced in a pulverisation process. The overwhelming majority of these second surfaces are essentially smooth cut or surfaces resulting from fracture without any plastic deformation, the proportion T of areas of plastic deformation of the second surfaces being $0 \leqq T \leqq 0.5$.

The embodiments disclosed herein were obtained based on the perception that the characteristics of the individual powder particles, in particular their fracture or surface characteristics, significantly affect the properties of the finished magnet core. It has been found that the surfaces of particles produced by pulverisation, for example of strip material, include areas of major plastic deformation. Mechanical stresses developing in these deformed areas result in undesirably high hysteresis losses. In addition, a high energy input in the pulverisation process leads to structural damage and the formation of nuclei for crystallite.

In the pressing process, too, mechanical stresses are introduced into the magnet core, and mechanical distortion due to different coefficients of thermal expansion for the powder and the pressing additive is possible. These stresses can, however, be reduced to an insignificant level by subsequent heat treatment.

Structural damage caused by deformation at the particle surface, however, cannot be repaired. For this reason, it has to be avoided largely in advance to reduce iron losses.

The proportion T of areas of plastic deformation of the particle surfaces is expediently limited to $0 \leqq T \leqq 0.2$.

By reducing mechanical stresses, in particular by reducing plastic deformation at the particle surfaces, cycle losses P of $P \leqq 5\ \mu Ws/cm^3$, preferably $P \leqq 3\ \mu Ws/cm^3$, are obtainable.

DETAILED DESCRIPTION OF SPECIFIC EMBODIMENTS

The nanocrystalline particles expediently have the alloy composition $(Fe_{1-a}M_a)_{100-x-y-z-\alpha-\beta-\gamma}Cu_xSi_yB_zM'_\alpha M''_\beta X_\gamma$, wherein M is Co and/or Ni, wherein M' is at least one element from the group consisting of Nb, W, Ta, Zr, Hf, Ti and Mo, wherein M" is at least one element from the group consisting of V, Cr, Mn, Al, elements of the platinum group, Sc, Y, rare earths, Au, Zn, Sn and Re, wherein X is at least one element from the group consisting of C, Ge, P, Ga, Sb, In, Be and As, and wherein a, x, y, z, ac, P and y are specified in atomic percent and meet the following conditions: $0 \leqq a \leqq 0.5$; $0.1 \leqq x \leqq 3$; $0 \leqq y \leqq 30$; $0 \leqq z \leqq 25$; $0 \leqq y+z \leqq 35$; $0.1 \leqq \alpha \leqq 30$; $0 \leqq \beta \leqq 10$; $0 \leqq \gamma \leqq 10$.

As an alternative, the particles may have the alloy composition $(Fe_{1-a-b}Co_aNi_b)_{100-x-y-z}M_xB_yT_z$, wherein M is at least one element from the group consisting of Nb, Ta, Zr, Hf, Ti, V and Mo, wherein T is at least one element from the group consisting of Cr, W, Ru, Rh, Pd, Os, Ir, Pt, Al, Si, Ge, C and P, and wherein a, b, x, y and z are specified in atomic percent and meet the following conditions: $0 \leqq a \leqq 0.29$; $0 \leqq b \leqq 0.43$; $4 \leqq x \leqq 10$; $3 \leqq y \leqq 15$; $0 \leqq z \leqq 5$.

The compositions listed above include alloys such as $Fe_{73.5}Cu_1Nb_3Si_{13.5}B_9$ and the non-magnetostrictive alloy $Fe_{73.5}Cu_1Nb_3Si_{15.5}B_7$.

A possible alternative are amorphous particles of the alloy composition $M_\alpha Y_\beta Z_\gamma$, wherein M is at least one element from the group consisting of Fe, Ni and Co, wherein Y is at least one element from the group consisting of B, C and P, wherein Z is at least one element from the group consisting of Si, Al and Ge, and wherein $\alpha$, $\beta$ and $\gamma$ are specified in atomic percent and meet the following conditions: $70 \leqq \alpha \leqq 85$; $5 \leqq \beta \leqq 20$; $0 \leqq \gamma \leqq 20$. Up to 10 atomic percent of the M component may be replaced by at least one element from the group consisting of Ti, V, Cr, Mn, Cu, Zr, Nb, Mo, Ta und W and up to 10 atomic percent of the (Y+Z) component may be replaced by at least one element from the group including In, Sn, Sb und Pb. These conditions are for example met by the alloy $Fe_{76}Si_{12}B_{12}$.

One possible pressing additive is glass solder, and ceramic silicates and/or thermosetting resins such as epoxy resins, phenolic resins, silicone resins or polyimides may also be used.

The magnet core described herein offers the advantage of significantly reduced iron losses compared to conventional powder composite cores, which can be ascribed to a reduction of the frequency-independent proportion of the losses, i.e. the hysteresis losses. The magnet core according to the invention can be used in inductive components such as chokes for correcting the power factor (PFC chokes), in storage chokes, filter chokes or smoothing chokes.

According to the invention, a method for the production of a magnet core comprises the following steps: first, a strip or foil of a typically amorphous, soft magnetic alloy is made available. The strip of foil may, however, alternatively be nanocrystalline. The term "strip" in this context includes fragments of strip or a roughly—i.e. without a particularly high energy input—crushed strip, for example flakes. The strip or foil is pulverised using a technique which causes a minimum of structural damage. This process is usually based on cutting and/or breaking. The aim is a pulverisation process with minimum energy input. For this purpose, the powder particles are removed from the pulverising chamber on reaching their final grain size, the dwell time t in the pulverising chamber preferably being $t<60$ s. The powder produced in this way is then mixed with at least one pressing additive and pressed to form a magnet core.

As a result of the short pulverisation process, the energy input into the powder particles produced, which would cause their plastic deformation, is kept to a minimum. As the strip is not pulverised by crushing or grinding, but mainly by cutting, those surfaces of the powder particles which represent new particle surfaces following pulverisation are largely smooth cut or fracture surfaces without any plastic deformation. Mechanical distortion, which would result in undesirably high hysteresis losses which cannot be reversed by heat treatment to the required degree, are in this production method avoided from the start.

Before pulverisation, the strip or foil is expediently made brittle by heat treatment, so that it can be pulverised even more easily and with a lower energy input. The amorphous strip can be converted into coarse-grained powder fractions at a temperature $T_{mill}$ of $-195°$ C.$\leqq T_{mill} \leqq 20°$ C., because such low temperatures improve grindability, thus further reducing the energy input of the process.

After pressing, the magnet core is expediently subjected to a heat treatment process, whereby distortions caused by the different coefficients of thermal expansion of powder and additive or pressing stresses can be eliminated. The heat treatment of the pressed magnet core also enables its magnetic properties to be adjusted as required.

In order to produce a magnet core of maximum homogeneity with defined properties, the powder is expediently subjected to a separation or grading process following pulverisation. Different size fractions of powder particles are then processes separately.

Example 1

In one embodiment of the method described herein, a strip was produced from an $Fe_{73.5}Cu_1Nb_3Si_{13.5}B_9$ alloy in a quick solidification process, followed by thermal embrittlement and pulverisation with minimum energy input, largely by cutting action. For comparison, a strip produced in the same way was pulverised by conventional methods. The fracture surfaces or particle surfaces of the powder particles produced according to the minimum energy input process described herein showed virtually no plastic deformation, while the conventionally produced powder particles exhibited major deformation. Both powders were graded, and identical fractions were mixed with 5 percent by weight of glass solder as a pressing additive. In a uniaxial hot pressing process, the mixtures were pressed to form powder cores at a temperature of 500° C. and a pressure of 500 MPa. The cycle losses of the magnet cores produced by these processes were then determined. The cycle losses correspond to the hysteresis losses during a complete magnetisation cycle. Cycle losses are determined by dividing the losses through frequency and by forming limit values for vanishing frequencies. Cycle losses depend on maximum modulation, but no longer on remagnetisation frequency.

Cycle losses following the pressing process were approximately 16 $\mu Ws/cm^3$ for conventionally produced magnet cores and approximately 15.8 $\mu Ws/cm^3$ for magnet cores produced according to the invention.

After pressing, the magnet cores were subjected to one hour's heat treatment at 520° C. to effect a nanocrystallisation of the powder particles. Following this, the cycle losses were once again determined. They were approximately 5.5 $\mu Ws/cm^3$ for conventionally produced magnet cores and approximately 2 $\mu Ws/cm^3$ for magnet cores produced according to the minimum energy input process described herein. During the heat treatment process, the stresses induced by pressing into the magnet core are therefore largely eliminated, and at the same time, the heat treatment effects the nanocrystallisation of originally amorphous structures and thus the adjustment of good magnetic properties. Following this, the hysteresis losses of the finished nanocrystalline powder cores are virtually exclusively determined by the characteristics of the fracture or particle surfaces.

Example 2

In a further embodiment of the method described herein, a strip was likewise produced from an $Fe_{73.5}Cu_1Nb_3Si_{13.5}B_9$ alloy in a quick solidification process, followed by thermal embrittlement and pulverisation with minimum energy input, largely by cutting action, in less than 60 s. For comparison, a strip produced in the same way was pulverised with high energy input and a duration of more than 600 s. Once again, the fracture surfaces or particle surfaces of the powder particles produced according to the minimum energy input process showed virtually no plastic deformation, while the conventionally produced powder particles exhibited major deformation.

As in the first example, the powders were graded and pressed together with glass solder to form magnet cores. After a heat treatment process as described above, the cycle losses of the magnet cores were determined. Magnet cores produced from different size fractions of powder particles were investigated separately in order to take account of the effect of particle size. For particles with a diameter of 200-300 μm, the cycle losses of the magnet cores produced according to the minimum energy input process amounted to 2.3 $\mu Ws/cm^3$ and for comparable cores produced by conventional means to 4.3 $\mu Ws/cm^3$.

For particles with a diameter of 300-500 μm, the cycle losses of the magnet cores produced according to the minimum energy input process amounted to 2.0 μWs/cm$^3$ and for comparable cores produced by conventional means to 3.2 μWs/cm$^3$. For particles with a diameter of 500-710 μm, the cycle losses of the magnet cores produced according to the minimum energy input process amounted to 1.7 μWs/cm$^3$ and for comparable cores produced by conventional means to 2.3 μWs/cm$^3$.

Example 3

In a further embodiment of the method described herein, a strip was likewise produced from an $Fe_{76}Si_{12}B_{12}$ alloy in a quick solidification process, followed by thermal embrittlement and pulverisation with minimum energy input, largely by cutting action, in less than 60 s to produce particles with a diameter of 200-300 μm.

As in the first and second examples, the powders were graded and pressed together with glass solder at a temperature of 420° C. to form magnet cores. Cycle losses were determined after a two-hour heat treatment process at 440° C. For particles with a diameter of 200-300 μm, the cycle losses of the magnet cores produced according to the minimum energy input process amounted to 4 μWs/cm$^3$ at a modulation of 0.1 T.

These examples show clearly that the cycle or hysteresis losses of powder cores are strongly affected by the characteristics of the fracture or particle surfaces and that the plastic deformation of these surfaces causes higher hysteresis losses.

The examples and embodiments described herein are provided to illustrate various embodiments of the invention, and are not limiting of the appended claims.

The invention claimed is:

1. A magnet core produced from a composite of a powder of amorphous or nanocrystalline particles and from at least one pressing additive, wherein the particles comprise a first surface that formed a surface of the strip from which the particles were produced, and a second surface that did not form a surface of the strip, but was produced in a pulverisation process that formed the particles from the strip, wherein said pulverising occurs during a dwell time t in a pulverising chamber such that t<60 s, wherein these second particle surfaces include surfaces formed by fracture without any plastic deformation, such that the proportion T of areas of plastic deformation of the second particle surfaces is $0 \leqq T \leqq 0.5$.

2. The magnet core according to claim 1, wherein the proportion T of areas of plastic deformation of the particle surfaces is $0 \leqq T \leqq 0.2$.

3. The magnet core according to claim 1, wherein the core has cycle losses P, such that $P \leqq 5$ μWs/cm$^3$.

4. The magnet core according to claim 3, wherein the core has cycle losses P, such that $P \leqq 3$ μWs/cm$^3$.

5. The magnet core according to claim 1, wherein the particles have the alloy composition $(Fe_{1-a}M_a)_{100-x-y-z-\alpha-\beta-\gamma}CU_xSi_{-y}B_zM'_aM''_\beta X_\gamma$, wherein M is Co and/or Ni, wherein M' is at least one element from the group consisting of Nb, W, Ta, Zr, Hf, Ti and Mo, wherein M' is at least one element from the group consisting of V, Cr, Mn, Al, elements of the platinum group, Sc, Y, rare earths, Au, Zn, Sn and Re, wherein X is at least one element from the group consisting of C, Ge, P, Ga, Sb, In, Be and As, and wherein a, x, y, z, α, β and γ are specified in atomic percent and meet the following conditions:

$0 \leqq a \leqq 0.5$;

$0.1 \leqq x \leqq 3$;

$0 \leqq y \leqq 30$;

$0 \leqq z \leqq 25$;

$0 \leqq y+ \leqq z \leqq 35$;

$0.1 \leqq \alpha \leqq 30$;

$0 \leqq \beta \leqq 10$; and $0 \leqq \gamma \leqq 10$.

6. The magnet core according to claim 1, wherein the particles have the alloy composition $(Fe_{1-a-b}Co_aNi_b)_{100-x-y-z}M_xB_yT_z$, wherein M is at least one element from the group consisting of Nb, Ta, Zr, Hf, Ti, V and Mo, wherein T is at least one element from the group consisting of Cr, W, Ru, Rh, Pd, Os, Ir, Pt, Al, Si, Ge, C and P, and wherein a, b, x, y and z are specified in atomic percent and meet the following conditions:

$0 \leqq a \leqq 0.29$;

$0 \leqq b \leqq 0.43$;

$4 \leqq x \leqq 10$;

$3 \leqq y \leqq 15$; and $0 \leqq z \leqq 5$.

7. The magnet core according to claim 1 , wherein the particles have the alloy composition $M_\alpha Y_\beta Z_\gamma$, wherein M is at least one element from the group consisting of Fe, Ni and Co, wherein Y is at least one element from the group consisting of B, C and P, wherein Z is at least one element from the group consisting of Si, Al and Ge, and wherein α, β and γ are specified in atomic percent and meet the following conditions:

$70 \leqq \alpha \leqq 85$;

$5 \leqq \beta \leqq 20$; and $0 \leqq \gamma \leqq 20$, wherein up to 10 atomic percent of the M component may be replaced by at least one element from the group consisting of Ti, V, Cr, Mn, Cu, Zr, Nb, Mo, Ta and W, and wherein up to 10 atomic percent of the (Y+Z) component may be replaced by at least one element from the group consisting of In, Sn, Sb and Pb.

8. The magnet core according to claim 1, wherein the pressing additive comprises a glass solder.

9. The magnet core according to claim 1, wherein the pressing additive comprises one or more ceramic silicates.

10. The magnet core according to claim 1, wherein the pressing additive comprises one or more thermosetting resins.

11. An inductive component comprising a magnet core according to claim 1.

12. The inductive component according to claim 11, comprising a choke for correcting a power factor.

13. The inductive component according to claim 11, comprising a storage choke.

14. The inductive component according to claim 11, comprising a filter choke.

15. The inductive component according to claim 11, comprising a smoothing choke.

16. A method for the production of a magnet core, comprising:

providing a strip or foil of an amorphous or nanocrystalline soft magnetic alloy;

pulverising the strip or foil in a pulverising chamber, wherein a sufficient degree of pulverising occurs by cutting and/or breaking of the amorphous or nanocrystalline magnetic alloy strip or foil to form powder particles that the number of powder particle surfaces that are formed during pulverizing and that are formed by fracture without any plastic deformation, are sufficient that the proportion T of areas of plastic deformation of these particle surfaces is $0 \leqq T \leqq 0.5$, wherein said pulverising occurs during a dwell time t in the pulverising chamber such that $t<60$ s;

removing the powder particles from the pulverising chamber on reaching their final particle size;

mixing the powder particles with one or more pressing additives;

pressing the resulting mixture to form a magnet core.

17. A method according to claim 16, further comprising heat treating the magnet core after pressing.

18. A method according to claim 16, further comprising embrittling the strip or foil by heat treating it prior to pulverisation.

19. A method according to claim 16, further comprising separating the powder particles into different powder fractions after said pulverising and separately further processing said powder fractions.

20. A method according to claim 16, wherein the strip or foil has the alloy composition $(Fe_{1-a}M_a)_{100-x-y-z-\alpha-\beta-\gamma}Cu_xSi_yB_zM'_\alpha M''_\beta X_\gamma$, wherein M is Co and/or Ni, wherein M' is at least one element from the group consisting of Nb, W, Ta, Zr, Hf, Ti and Mo, wherein M" is at least one element from the group consisting of V, Cr, Mn, Al, elements of the platinum group, Sc, Y, rare earths, Au, Zn, Sn and Re, wherein X is at least one element from the group consisting of C, Ge, P, Ga, Sb, In, Be and As, and wherein a, x, y, z, α, β and γare specified in atomic percent and meet the following conditions:

$0 \leqq a \leqq 0.5$;

$0.1 \leqq x \leqq 3$;

$0 \leqq y$ $0 \leqq z$ $0 \leqq y+z \leqq 35$;

$0.1 \leqq \alpha \leqq 30$;

$0 \leqq \beta \leqq 10$; and $0 \leqq \gamma \leqq 10$.

21. A method according to claim 16, wherein the strip or foil has the alloy composition $(Fe_{1-a-b}Co_aNi_b)_{100-x-y-z}M_xB_yT_z$, wherein M is at least one element from the group consisting of Nb, Ta, Zr, Hf, Ti, V and Mo, wherein T is at least one element from the group consisting of Cr, W, Ru, Rh, Pd, Os, Ir, Pt, Al, Si, Ge, C and P, and wherein a, b, x, y and z are specified in atomic percent and meet the following conditions:

$0 \leqq a \leqq 0.29$;

$0 \leqq b \leqq 0.43$;

$4 \leqq x \leqq 10$;

$3 \leqq y \leqq 15$; and $0 \leqq z \leqq 5$.

22. A method according to claim 16, wherein the strip or foil has the alloy composition $M_\alpha Y_\beta Z_\gamma$, wherein M is at least one element from the group consisting of Fe, Ni and Co, wherein Y is at least one element from the group consisting of B, C and P, wherein Z is at least one element from the group consisting of Si, Al and Ge, and wherein α, β and γ are specified in atomic percent and meet the following conditions:

$70 \leqq \alpha \leqq 85$;

$5 \leqq \beta \leqq 20$; and $0 \leqq \gamma \leqq 20$, wherein up to 10 atomic percent of the M component may be replaced by at least one element from the group consisting of Ti, V, Cr, Mn, Cu, Zr, Nb, Mo, Ta and W, and wherein up to 10 atomic percent of the (Y+Z) component may be replaced by at least one element from the group consisting of In, Sn, Sb and Pb.

23. A method according to claim 16, wherein the one or more pressing additives comprise a glass solder.

24. A method according to claim 16, wherein the one or more pressing additives comprise one or more ceramic silicates.

25. A method according to claim 16, wherein the one or more pressing additives comprise one or more thermosetting resins.

26. The magnet core according to claim 10, wherein the thermosetting resins comprise one or more of an epoxy resin, a phenolic resin, a silicone resin or a polyimide.

27. The method according to claim 25, wherein the thermosetting resins comprise one or more of an epoxy resin, a phenolic resin, a silicone resin or a polyimide.

28. The magnet core according to claim 1, wherein the particles have the alloy composition $Fe_{73.5}Cu_1Nb_3Si_{13.5}B_9$, the alloy composition $Fe_{76}Si_{12}B_{12}$, or the alloy composition $Fe_{73.5}Cu_1Nb_3Si_{15.5}B_7$.

29. The magnet core according to claim 28, wherein the magnet core has cycle losses P, such that $P \leqq 5$ μWs/cm$^3$.

30. The magnet core according to claim 29, wherein the cycle losses P are such that $P \leqq 3\ \mu Ws/cm^3$.

31. The method of claim 16, wherein said pulverising is conducted at a temperature $T_{mill}$, such that $-195°\ C. \leqq T_{mill} 20°\ C.$

32. A magnet core produced from a composite of:

a powder of amorphous or nanocrystalline particles having the alloy composition $(Fe_{1-a-b}Co_aNi_b)_{100-x-y-z}M_xB_yT_z$, wherein M is at least one element from the group consisting of Nb, Ta, Zr, Hf, Ti, V and Mo, wherein T is at least one element from the group consisting of Cr, W, Ru, Rh, Pd, Os, Ir, Pt, Al, Si, Ge, C and P, and wherein a, b, x, y and z are specified in atomic percent and meet the following conditions:

$0 \leqq a \leqq 0.29$;

$0 \leqq b \leqq 0.43$;

$4 \leqq x \leqq 10$;

$3 \leqq y \leqq 15$; and $0 \leqq z \leqq 5$; and at least one pressing additive, comprising a glass solder or one or more ceramic silicates;

wherein the particles comprise a first surface that formed a surface of the strip from which the particles were produced, and a second surface that did not form a surface of the strip, but was produced in a pulverisation process that formed the particles from the strip, wherein these second particle surfaces include surfaces formed by fracture without any plastic deformation, such that the proportion T of areas of plastic deformation of the second particle surfaces is $0 \leqq T \leqq 0.5$.

33. A method for the production of a magnet core, comprising:

providing a strip or foil of an amorphous or nanocrystalline soft magnetic alloy having composition $(Fe_{1-a-b}Co_aNi_b)_{100-x-y-z}M_xB_yT_z$, wherein M is at least one element from the group consisting of Nb, Ta, Zr, Hf, Ti, V and Mo, wherein T is at least one element from the group consisting of Cr, W, Ru, Rh, Pd, Os, Ir, Pt, Al, Si, Ge, C and P, and wherein a, b, x, y and z are specified in atomic percent and meet the following conditions:

$0 \leqq a \leqq 0.29$;

$0 \leqq b \leqq 0.43$;

$4 \leqq x \leqq 10$;

$3 \leqq y \leqq 15$; and $0 \leqq z \leqq 5$;

pulverising the strip or foil in a pulverising chamber, wherein a sufficient degree of pulverising occurs by cutting and/or breaking of the amorphous or nanocrystalline magnetic alloy strip or foil to form powder particles, that the number of powder particle surfaces that are formed during pulverizing and that are formed by fracture without any plastic deformation, are sufficient that the proportion T of areas of plastic deformation of these particle surfaces is $0 \leqq T \leqq 0.5$;

removing the powder particles from the pulverising chamber on reaching their final particle size;

mixing the powder particles with one or more pressing additives selected from a glass solder and one or more ceramic silicates; and pressing the resulting mixture to form a magnet core.

* * * * *

UNITED STATES PATENT AND TRADEMARK OFFICE

CERTIFICATE OF CORRECTION

PATENT NO. : 8,372,218 B2
APPLICATION NO. : 12/308179
DATED : February 12, 2013
INVENTOR(S) : Dieter Nuetzel et al.

It is certified that error appears in the above-identified patent and that said Letters Patent is hereby corrected as shown below:

In the Claims

Col. 7, Claim 20, line 55 delete "$0 \leq y$" and replace therewith -- $0 \leq y \leq 30$. --

Col. 7, Claim 20, line 58 delete "$0 \leq z$" and replace therewith -- $0 \leq z \leq 25$. --

Signed and Sealed this
Sixteenth Day of December, 2014

Michelle K. Lee

Michelle K. Lee
*Deputy Director of the United States Patent and Trademark Office*